US011668148B1

(12) United States Patent
Dong et al.

(10) Patent No.: US 11,668,148 B1
(45) Date of Patent: Jun. 6, 2023

(54) DOWNHOLE EXPLOSION ROBOT BASED ON PLANETARY ROLLER SCREW TELESCOPING AND TRACTION METHOD THEREOF

(71) Applicant: Chengdu University of Technology, Chengdu (CN)

(72) Inventors: Xuelian Dong, Chengdu (CN); Haiyan Zhu, Chengdu (CN); Qiaozhu Wang, Chengdu (CN); Jingran Tang, Chengdu (CN); Qingyou Liu, Chengdu (CN); Xingming Wang, Chengdu (CN); Linfeng Sun, Chengdu (CN)

(73) Assignee: Chengdu University of Technology, Chengdu (CN)

( * ) Notice: Subject to any disclaimer, the term of this patent is extended or adjusted under 35 U.S.C. 154(b) by 0 days.

(21) Appl. No.: 17/983,826

(22) Filed: Nov. 9, 2022

(30) Foreign Application Priority Data

Aug. 1, 2022 (CN) ..... 202210914654.X

(51) Int. Cl.
*E21B 23/00* (2006.01)
*E21B 23/04* (2006.01)
(Continued)

(52) U.S. Cl.
CPC ..... *E21B 23/001* (2020.05); *E21B 17/073* (2013.01); *E21B 23/042* (2020.05);
(Continued)

(58) Field of Classification Search
CPC ..... E21B 23/001; E21B 23/04; E21B 23/042; E21B 23/0421
See application file for complete search history.

(56) References Cited

U.S. PATENT DOCUMENTS 4,770,105 A * 9/1988 Takagi ..... F16L 55/30 73/866.5
4,862,808 A * 9/1989 Hedgcoxe ..... B62D 61/10 105/365
(Continued)

FOREIGN PATENT DOCUMENTS

AU 2482000 A 7/2000
CN 101054896 A 10/2007
(Continued)

*Primary Examiner* — D. Andrews
*Assistant Examiner* — Ronald R Runyan
(74) *Attorney, Agent, or Firm* — Nitin Kaushik

(57) ABSTRACT

The present invention relates to the technical field of development of underground resources such as petroleum, natural gas, geothermal energy, etc., in particular to a downhole explosion robot based on planetary roller screw telescoping and traction method thereof. The present invention provides a downhole explosion robot based on planetary roller screw telescoping and traction method thereof, comprising a rear joint, a rear main body, a telescopic sub, a front main body, and a front joint, and the rear main body is provided with a rear control sub and a rear support sub; the front main body is provided with a front support sub and a front control sub, and the telescopic sub is respectively connected with the rear support sub and the front support sub. The invention has the advantages of reliability and stability, with less impact on the tube string, and can be applicable to smaller wellbore.

8 Claims, 8 Drawing Sheets

(51) Int. Cl.
*E21B 17/07* (2006.01)
*E21B 43/263* (2006.01)

(52) U.S. Cl.
CPC ..... *E21B 23/0411* (2020.05); *E21B 23/0412* (2020.05); *E21B 43/263* (2013.01)

(56) References Cited

U.S. PATENT DOCUMENTS

| | | | | | |
|---|---|---|---|---|---|
| 4,938,081 | A * | 7/1990 | Negishi | F16L 55/28 | 92/92 |
| 5,018,451 | A * | 5/1991 | Hapstack | F16L 55/34 | 104/138.2 |
| 5,121,694 | A * | 6/1992 | Zollinger | F16L 55/28 | 104/138.1 |
| 5,293,823 | A * | 3/1994 | Box | F16L 55/34 | 104/138.2 |
| 6,450,104 | B1 * | 9/2002 | Grant | B08B 9/049 | 104/138.1 |
| 2006/0207770 | A1 | 9/2006 | Kotsonis et al. | | |
| 2010/0307832 | A1 * | 12/2010 | Mock | E21B 4/18 | 175/99 |
| 2012/0152533 | A1 * | 6/2012 | Hoefel | E21B 49/088 | 166/264 |

FOREIGN PATENT DOCUMENTS

| | | | | |
|---|---|---|---|---|
| CN | 102155215 | A | 8/2011 | |
| CN | 104060960 | A | 9/2014 | |
| CN | 104879073 | A | 9/2015 | |
| CN | 206091977 | U | 4/2017 | |
| CN | 107366523 | A | 11/2017 | |
| CN | 108868603 | A | 11/2018 | |
| CN | 109519163 | A | 3/2019 | |
| CN | 109519164 | A | 3/2019 | |
| EP | 0964131 | A2 * | 5/1999 | E21B 23/14 |
| EP | 2770158 | A1 | 8/2014 | |

* cited by examiner

DOWNHOLE EXPLOSION ROBOT BASED ON PLANETARY ROLLER SCREW TELESCOPING AND TRACTION METHOD THEREOF

CROSS-REFERENCE TO RELATED APPLICATIONS

The application claims priority to Chinese patent application No. 202210914654.X, filed on Aug. 1, 2022, the entire contents of which are incorporated herein by reference.

TECHNICAL FIELD

The present invention relates to the technical field of development of underground resources such as petroleum, natural gas, geothermal energy, etc., in particular to a downhole explosion robot based on planetary roller screw telescoping and traction method thereof.

BACKGROUND

The first thing in mining underground resources is to open the outflow channel of underground resources.

Once the drilling process is completed, the well completion will be performed.

During the oil exploitation, the completion of oil and gas wells includes topping the oil sand, selection of completion methods, cementing, and perforating operations.

After cementing, the special completion tools are run in, such as cables, perforating guns, tractors and other detection tools.

The completion tools are installed at the end of the cable, and are run in by the roller on the ground.

The roller and the tractor provide forward power to pull the completion tools and cables at the end and run them into the designated position downhole.

After running into place, the perforating gun works and starts to launch perforating bullets around the wellbore to complete the perforation operation and form artificial fractures.

Most of the explosion robots involved in the operation process cannot meet the requirements of running speed, accuracy and economical cost, and have complex structures, requiring a lot of financial resources.

Moreover, there is much room for improvement in the structural design of downhole explosion robots and tractors at home and abroad. Therefore, it is urgent to design an explosion robot with a new structure for explosive fracturing.

SUMMARY

In order to overcome the problems in the prior art, the present invention provides a downhole explosion robot based on planetary roller screw telescoping and traction method thereof.

The technical solution provided by the present invention to solve the above-mentioned technical issues is: a downhole explosion robot based on planetary roller screw telescoping, comprising a rear joint, a rear main body, a telescopic sub, a front main body, and a front joint connected in sequence from left to right, the rear main body and the front main body are provided with axial through-holes, and the rear main body is provided with a rear control sub and a rear support sub;

the front main body is provided with a front support sub and a front control sub, and the telescopic sub is respectively connected with the rear support sub and the front support sub, wherein the front support sub, the front control sub, the front main body and the front joint are respectively distributed symmetrically with the rear support sub, the rear control sub, the rear main body and the rear joint with respect to the telescopic sub;

the rear control sub controls the rear support sub to enter the support state or the non-support state, and the front control sub controls the front support sub to enter the support state or the non-support state:

The further technical solution is that the rear support sub includes a rear support cylinder, a rear support cylinder flange, a rear support cylinder piston, and a rear support mechanism, the rear support cylinder flange is connected with the left end of the rear support cylinder, and the rear support cylinder piston is sleeved in the middle of the rear support cylinder and the rear main body, and can slide relatively;

The rear support mechanism includes a rear support rear sliding seat, a rear support rear arm, a rear support rear link, a rear support block, a rear support front arm, a rear support front link, and a rear support front sliding seat;

The left end of the rear support rear arm is rotatably connected with the left end of the rear support rear sliding seat, and the left and right ends of the rear support block are respectively rotatably connected with the right end of the rear support rear arm and the left end of the rear support front arm, the right end of the rear support front arm is rotatably connected to the right end of the rear support front sliding sent, the left and right ends of the rear support rear link are respectively rotatably connected to the right end of the rear support rear sliding seat and the middle of the rear support block, and the left and right ends of the rear support front link are respectively rotatably connected with the middle of the rear support block and the left end of the rear support front sliding seat;

The rear support cylinder flange and the rear support front sliding seat are threadedly connected with the rear main body to limit the relative position of the rear support sub; the rear support rear sliding seat is connected with the protruding portion of the rear support cylinder piston.

The further technical solution is that the rear main body is provided with a rear oil hole that is communicated with the rear support cylinder, the rear control sub includes a rear control sub main body, the rear control sub main body is provided with a rear control sub built-in groove, a rear control sub power hole, and a rear oil passage, and the rear control sub built-in groove is communicated with the rear oil hole through the rear oil passage.

The further technical solution is that the telescopic sub includes a telescopic protective cover, a motor fixing frame, a drive motor, a bearing and a planetary roller screw mechanism slidably installed in the telescopic protective cover; the planetary roller screw mechanism includes multiple planetary rollers, nuts, and lead screws;

The motor fixing frame and the bearing are installed in the left end of the telescopic protective cover, the drive motor is installed on the motor fixing frame, the telescopic protective cover is internally provided with a limit rail, and the nut is slidably installed in the limit rail;

Both ends of the planetary roller are provided with gear teeth and a cage in sequence from the inside to the outside, the planetary roller is threadedly installed in the nut, and the nut is internally provided with a snap ring for limiting the planetary roller at the left end of the inner chamber of the nut;

The lead screw is installed in the bearing and the planetary roller, and the rotating shaft of the drive motor is connected with the lead screw through a coupling; the telescopic protective cover is connected with the rear support front sliding seat.

The further technical solution is that the front support sub includes a front support cylinder, a front support cylinder flange, a front support cylinder piston, and a front support mechanism; the front support cylinder flange is connected with the right end of the front support cylinder, and the front support cylinder piston is sleeved in the middle of the front support cylinder and the front main body, and can slide relatively;

The front support mechanism includes a front support rear sliding seat, a front support rear arm, a front support front link, a front support block, a front support front arm, a front support rear link, and a front support front sliding seat;

The right end of the front support rear arm is rotatably connected to the right end of the front support rear sliding seat, and the left and right ends of the front support block are rotatably connected to the right end of the front support front arm and the left end of the front support rear arm respectively, the left end of the front support front arm is rotatably connected with the left end of the front support front sliding seat, the left and right ends of the front support front link are respectively connected with the middle of the front support block and the left end of the front support rear sliding seat, and the left and right ends of the front support rear link are rotatably connected with the right end of the front support front sliding seat and the middle part of the front support block respectively:

The front support cylinder flange and the front support front sliding seat are threadedly connected with the front main body to limit the relative position of the front support sub; the front support rear sliding seat is connected with the protruding portion of the front support cylinder piston, and the front support front sliding seat is connected with the right end of the nut.

The further technical solution is that the front main body is provided with a front oil hole that is communicated with the front support cylinder, the front control sub includes a front control sub main body, and the front control sub main body is provided with a front control sub built-in groove, a front control sub power hole, and a front oil passage, and the rear control sub built-in groove is communicated with the front oil hole through the front oil passage.

The further technical solution is that both the rear support sub and the front support sub are provided with pressure sensors.

A traction method of a downhole explosion robot based on planetary roller screw telescoping, comprising the following steps:

Step 1. Adjust the explosion robot to the initial state, and the initial state is that the rear support cylinder piston is located at the left end of the rear support cylinder, the front support cylinder piston is located at the right end of the front support cylinder, the rear support mechanism and the front support mechanism are both in a contracted state, and the planetary roller is located at the left end of the lead screw and the nut;

Step 2. Inject hydraulic oil into the left chamber of the rear support cylinder to push the rear support cylinder piston to move to the right, so as to drive the rear support mechanism to open and make close contact with the casing to fix the rear half of the entire explosion robot;

Step 3. The drive motor starts to rotate forward, and the drive motor rotates to drive the lead screw to rotate; since the lead screw and the planetary roller are threadedly matched, the lead screw rotates to drive the planetary roller to roll; the nut moves to the right together with the planetary roller under the movement of the planetary roller; at the same time, the front half of the explosion robot connected with the nut also advances to the right with the nut until the planetary roller moves to the rightmost end of the lead screw;

Step 4. Inject hydraulic oil into the right chamber of the front support cylinder, thereby pushing the front support cylinder piston to move to the left; when the front support cylinder piston moves to the left, it drives the front support mechanism to open, and make close contact with the casing to fix the front half of the entire explosion robot;

Step 5. Inject hydraulic oil into the right chamber of the rear support cylinder, the left chamber of the rear support cylinder returns oil, and at the same time the rear support cylinder piston moves to the left to drive the rear support mechanism to contract and reset;

Step 6. After the rear support mechanism is reset, the drive motor starts to reverse, the lead screw rotates and moves to the right, and the lead screw pulls the second half of the entire explosion robot forward until the planetary roller returns to the leftmost end of the lead screw;

Step 7. Inject hydraulic oil into the left chamber of the rear support cylinder, push the rear support cylinder piston to move to the right, thereby driving the rear support mechanism to open and make close contact with the casing to fix the second half of the entire explosion robot:

Step 8. Inject hydraulic oil into the left chamber of the front support cylinder, push the front support cylinder piston to move to the right, thereby driving the front support mechanism to contract and reset, so as to carry out the next action;

Step 9. Cycle Step 3 to Step 8 to complete the horizontal movement of the explosive fracturing robot, and complete the delivery of the downhole explosion operating tools and other tools to the designated position and the traction of the pipe string;

Step 10. After completing the delivery of the downhole explosion operating tools and other tools to the designated position and the traction of the pipe string, inject hydraulic oil into the right chamber of the rear support cylinder, push the rear support cylinder piston move to the left, thereby driving the rear support mechanism to retract and reset, so that the entire explosion robot returns to its initial state.

The further technical solution is that the injection process of the hydraulic oil in Step 2 is: The control circuit controls the solenoid valve in the rear control sub to start working, the hydraulic oil in the oil cylinder in the rear control sub flows into the rear oil hole in the rear main body through the solenoid valve, and the hydraulic oil finally flows into the left chamber of the rear support cylinder;

In Step 2, after the rear support mechanism is in close contact with the casing, the pressure sensor sends a signal to the control circuit, and the control circuit controls the solenoid valve in the rear control sub to stop pumping hydraulic oil into the rear support cylinder.

The further technical solution is that the injection process of the hydraulic oil in Step 4 is: the control circuit controls the solenoid valve in the front control sub to start working, the hydraulic oil in the front control sub flows into the front oil hole in the front main body through the solenoid valve, and the hydraulic oil finally flows into the right chamber of the front support cylinder;

In Step 4, after the front support mechanism is in close contact with the casing, the pressure sensor sends a signal to the control circuit, and the control circuit controls the solenoid valve in the front control sub to stop pumping hydraulic oil into the front support cylinder.

The present invention has the following beneficial effects:

1. The explosion robot is designed with a planetary roller mechanism for telescopic traction, which can simplify the structural design: The use of a planetary roller screw mechanism instead of a hydraulic telescoping mechanism reduces the hydraulic valve and other electronic components needed for hydraulic telescoping, thus simplifying the structural design of the body. The oil circuits and the number of holes are reduced, which to some extent increases the stiffness of the explosion robot and brings greater stability.

2. The planetary roller screw mechanism is used in the telescopic sub of the explosion robot to realize the structural design of small size and large traction force of the downhole explosion robot: The planetary roller screw has the advantages of small size, high transmission precision, high mechanical transmission efficiency and low production cost;

3. The telescopic mechanism of the explosion robot is the planetary roller screw for telescoping. The telescopic structure of the planetary roller screw has a reliable and stable motion state, with less impact on the tube string; the planetary roller screw mechanism has good high temperature and high pressure resistance and sealing performance, can operate normally under long-term high temperature and high pressure in horizontal wells, and has a long service life; and it has good self-locking performance, which can maintain a stable state of motion under complex downhole conditions;

4. The robot is applicable to a wide range of wellbores: The small size structure design achieved by the use of planetary roller screw telescoping for the explosion robot can make the overall structure of the robot small, and the robot controls the degree of opening of the front and rear support mechanisms by controlling the stroke of the front and rear support cylinder pistons. In wells with a larger borehole size, the support cylinder piston needs to travel more to push the support mechanism to open wider and make close contact with the casing; in wells with a smaller borehole size, the support cylinder piston needs to travel less to push the support mechanism to open smaller and make close contact with the casing;

5. The robot is applicable to different downhole operation stages: The traction method using planetary roller screw telescoping can be used not only in the explosion robot during the horizontal well explosive fracturing, but also in the drilling robot in the drilling process, and can be applied to all tools that require traction during downhole operations.

Figure 1:
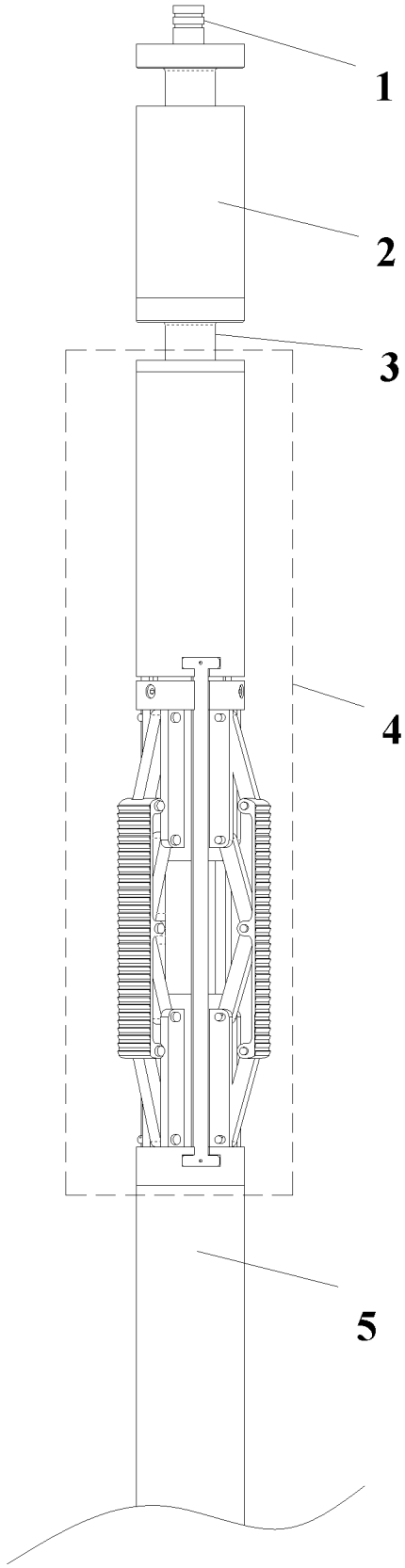
FIG. 1 is the left half view of the overall structure schematic diagram of the present invention.

1—Rear joint, 2—Rear control sub, 201—Rear control sub main body, 202—Rear control sub built-in groove, 203—Rear control sub power hole, 204—Rear oil passage, 3—Rear main body, 4—Rear support nipple, 401—Rear support cylinder flange, 402—Rear support cylinder, 403 Rear support cylinder piston, 404—Rear support rear sliding seat, 405—Rear support rear arm, 406—Rear support block, 407—Rear support front arm, 408—Rear support front sliding seat, 5—Telescopic sub, 501—Telescopic protective cover, 502—Limit rail, 503—Motor fixing frame, 504—Drive motor, 505—Bearing, 506—Gear teeth, 507—Planetary roller, 508—Cage. 509—Snap ring, 510—Nut, 511—Lead screw, 6—Front support sub, 601—Front support cylinder flange, 602—Front support cylinder piston, 603—Front support cylinder, 604—Front support rear sliding seat, 605—Front support rear arm, 606—Front support block, 607—Front support front arm, 608—Front support front sliding seat, 7—Front control sub, 701—Front control sub main body, 702—Front control sub built-in groove, 703—Front control sub power hole, 704—Front oil passage. 8—Front main body, 9—Front joint.

DETAILED DESCRIPTION OF THE EMBODIMENTS

The technical solutions of the embodiments of the present invention will be described expressly and integrally in conjunction with the appended figures of the embodiments of the present invention. It is clear that the described embodiments are some but not all of the embodiments of the present invention. According to the embodiments of the present invention, all other embodiments obtained by those of ordinary skill in the art without creative effort fall within the protection scope of the present invention.

In the description of the present invention, it should be noted that the orientation or positional relationship indicated by the terms "center", "upper", "lower", "left", "right", "vertical", "horizontal", "inner", "outer", etc. is based on the orientation or positional relationship shown in the accompanying drawings, which is intended only to facilitate and simplify the description of the invention, not to indicate or imply that the device or element referred to must have a particular orientation, be constructed and operate in a particular orientation, and therefore should not be construed as a limitation of the present invention. Furthermore, the terms "first", "second", and "third" are used for descriptive purposes only and should not be construed to indicate or imply relative importance.

In the description of the present invention, it should be noted that the terms "installation", "connected" and "connection" should be understood in a broad sense, unless otherwise expressly specified and limited, for example, it may be a fixed connection or a detachable connection, or an integral connection; it may be a mechanical connection. For those of ordinary skill in the art, the specific meanings of the above terms in the present invention can be understood according to specific situations.

In addition, the technical features involved in the different embodiments of the present invention described below can be combined with each other as long as they do not conflict with each other.

Figure 2:
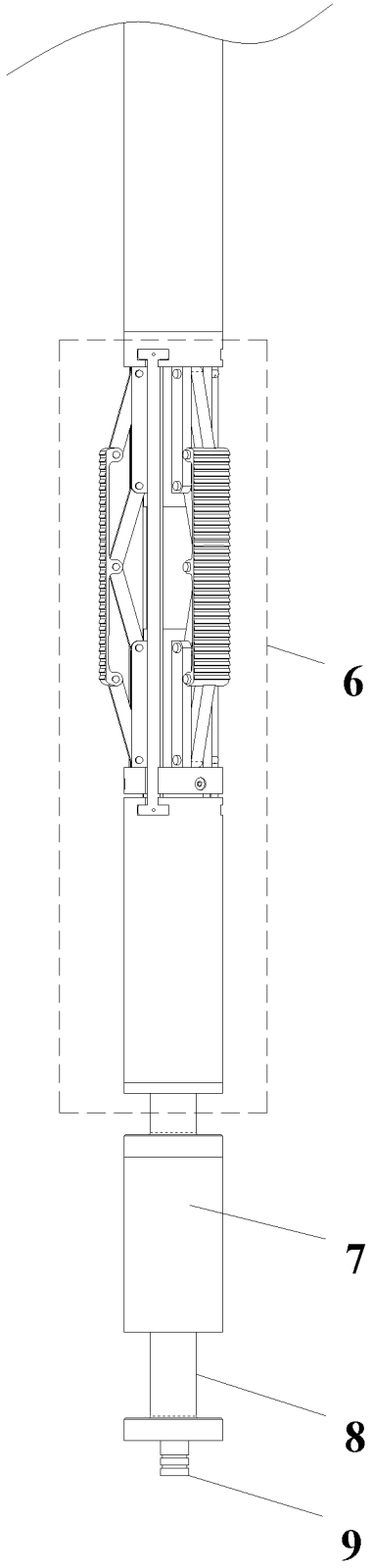
FIG. 2 is the right half view of the overall structure schematic diagram of the present invention.

As shown in FIG. 1 and FIG. 2, the present invention proposes a downhole explosion robot based on planetary roller screw telescoping, including a rear joint 1, a rear main body 3, a telescopic sub 5, a front main body 8, and a front joint 9 connected in sequence from left to right, the rear main body 3 and the front main body 8 are provided with axial through-holes, and the rear main body 3 is provided with a rear control sub 2 and a rear support sub 4; the front main body 8 is provided with a front support sub 6 and a front control sub 7, and the telescopic sub 5 is respectively connected with the rear support sub 4 and the front support sub 6, wherein the front support sub 6, the front control sub 7, the front main body 8 and the front joint 9 are respectively distributed symmetrically with the rear support sub 4, the rear control sub 2, the rear main body 3 and the rear joint 1 with respect to the telescopic sub 5; the rear control sub 2 controls the rear support sub 4 to enter the support state or the non-support state, and the front control sub 7 controls the front support sub 6 to enter the support state or the non-support state.

Figure 3:
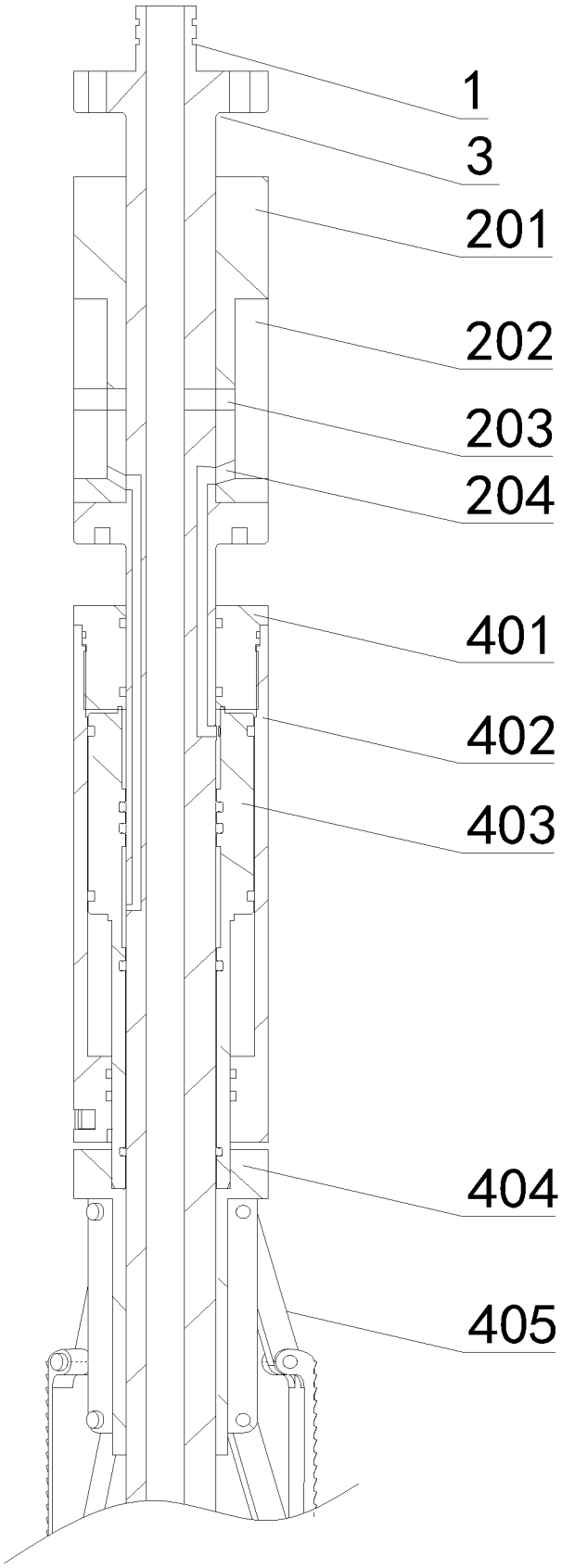
FIG. 3 is the left half view of the mechanism section of the present invention.
Figure 4:
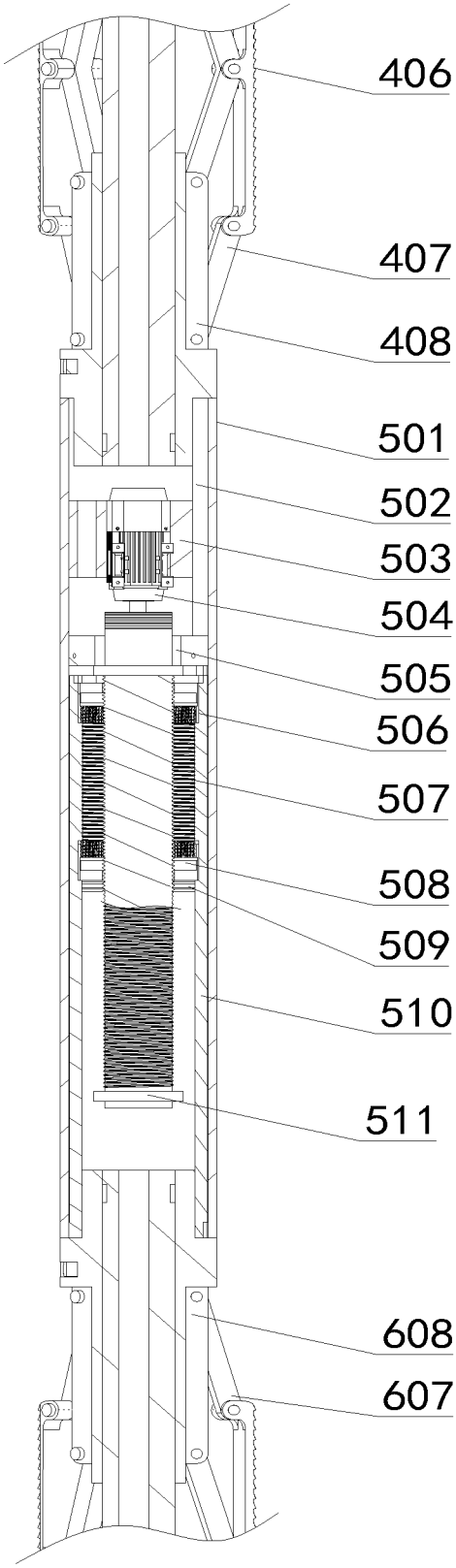
FIG. 4 is the middle portion view of the mechanism section of the present invention.
Figure 5:
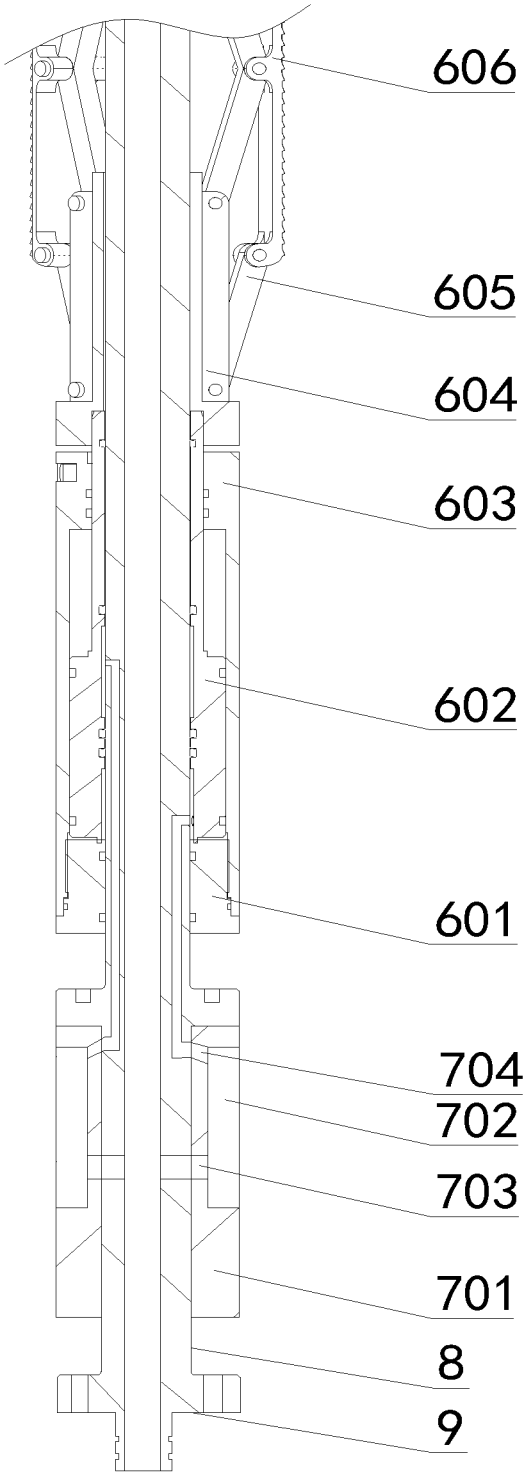
FIG. 5 is the right half view of the mechanism section of the present invention.

As shown in FIG. 3, FIG. 4, and FIG. 5, the rear support sub 4 includes a rear support cylinder 402, a rear support cylinder flange 401, a rear support cylinder piston 403, and a rear support mechanism, the rear support cylinder flange 401 is connected with the left end of the rear support cylinder 402, and the rear support cylinder piston 403 is sleeved in the middle of the rear support cylinder 402 and the rear main body 3, and can slide relatively;

The rear support mechanism includes a rear support rear sliding seat 404, a rear support rear arm 405, a rear support rear link, a rear support block 406, a rear support front arm 407, a rear support front link, and a rear support front sliding seat 408;

The left end of the rear support rear arm 405 is rotatably connected with the left end of the rear support rear sliding seat 404, and the left and right ends of the rear support block 406 are respectively rotatably connected with the right end of the rear support rear arm 405 and the left end of the rear support front arm 407, the right end of the rear support front arm 407 is rotatably connected to the right end of the rear support front sliding seat 408, the left and right ends of the rear support rear link are respectively rotatably connected to the right end of the rear support rear sliding seat 404 and the middle of the rear support block 406, and the left and right ends of the rear support front link are respectively rotatably connected with the middle of the rear support block 406 and the left end of the rear support front sliding seat 408:

The rear support cylinder flange 401 and the rear support front sliding seat 408 are threadedly connected with the rear main body 3 to limit the relative position of the rear support sub 4; the rear support rear sliding seat 404 is connected with the protruding portion of the rear support cylinder piston 403;

The rear main body 3 is provided with a rear oil hole that is communicated with the rear support cylinder 402, the rear control sub 2 includes a rear control sub main body 201, the rear control sub main body 201 is provided with a rear control sub built-in groove 202, a rear control sub power hole 203, and a rear oil passage 204, and the rear control sub built-in groove 202 is communicated with the rear oil hole through the rear oil passage 204.

The rear joint 1 is at the left end (near the wellhead end) of the rear main body 3, and is used to connect with other downhole operating tools. The rear main body 3 passes through the rear control sub 2 and the rear support sub 4; the rear control sub built-in groove 202 is used for placing electronic components such as hydraulic valves and used as a hydraulic oil tank.

Specifically, the workflow is as follows: When the hydraulic oil flows into the left chamber of the rear support cylinder 402 through the rear oil passage 204, the rear support cylinder piston 403 extends and pushes the rear support rear sliding seat 404, thereby driving the support mechanism to open for support in the casing; when the hydraulic oil flows into the right chamber of the rear support cylinder 402, the rear support cylinder piston 403 retracts and pulls the rear support rear sliding seat 404, thereby driving the support mechanism to contract.

Figure 6:
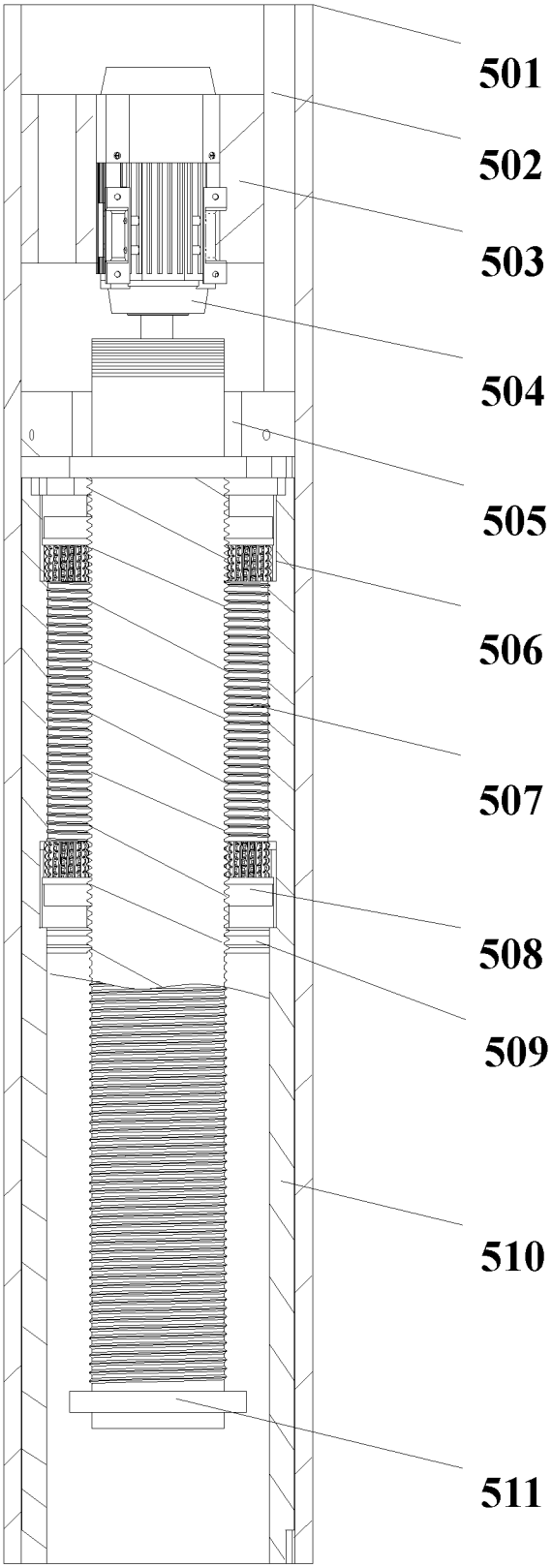
FIG. 6 is a schematic diagram of the telescopic sub structure.

As shown in FIG. 6, the telescopic sub 5 includes a telescopic protective cover 501, a motor fixing frame 503, a drive motor 504, a bearing 505 and a planetary roller screw mechanism slidably installed in the telescopic protective cover 501; the planetary roller screw mechanism includes multiple planetary rollers 507, nuts 510, and lead screws 511;

The motor fixing frame 503 and the bearing 505 are installed in the left end of the telescopic protective cover 501, the drive motor 504 is installed on the motor fixing frame 503, the telescopic protective cover 501 is internally provided with a limit rail 502, and the nut 510 is slidably installed in the limit rail 502;

Both ends of the planetary roller 507 are provided with gear teeth 506 and a cage 508 in sequence from the inside to the outside, the planetary roller 507 is threadedly installed in the nut 510, and the nut 510 is internally provided with a snap ring 509 for limiting the planetary roller 507 at the left end of the inner chamber of the nut 510;

The lead screw 511 is installed in the bearing 505 and the planetary roller 507, and the rotating shaft of the drive motor 504 is connected with the lead screw 511 through a coupling; the telescopic protective cover 501 is connected with the rear support front sliding seat 408.

The specific work flow of the telescopic sub 5 is as follows:

When the drive motor 504 is reversed, the nut 510 normally performs linear motion, and prevents the entire telescopic sub from being exposed to complex working conditions, and the motor fixing frame 503 is used to fix the drive motor 504; the planetary rollers 507 are threadedly matched with the lead screw 511, and multiple planetary rollers 507 are evenly distributed on the outer circumference of the lead screw 511, each planetary roller 507 is gear-meshed with each other by the gear teeth 506 at the ends of the planetary roller 507, and the planetary roller 507 and the cage 508 work together and can be rotated; the snap ring 509 is used to limit the planetary roller 507 at the left end of the nut 510; when the drive motor 504 rotates forward, under the action of the bearing 505, only the lead screw 511 rotates in the entire telescopic mechanism, which drives the planetary roller 507 to engage in gears while rotating, and drives the nut 510 forward in a linear motion, and the nut 510 moves to the right relative to the telescopic protective cover 501 and extends; when the drive motor 504 is reversed, under the action of the bearing 505 and the fixing action of the support sub, the planetary roller 507 rotates, but at this time, the portion other than the planetary roller 507 moves forward in a straight line relatively, and meanwhile, the telescopic protective cover 501 also moves relatively to the right to complete the retracting action.

As shown in FIG. 3, FIG. 4, and FIG. 5, the front support sub 6 includes a front support cylinder 603, a front support cylinder flange 601, a front support cylinder piston 602, and a front support mechanism; the front support cylinder flange 601 is connected with the right end of the front support cylinder 603, and the front support cylinder piston 602 is sleeved in the middle of the front support cylinder 603 and the front main body 8, and can slide relatively;

The front support mechanism includes a front support rear sliding seat 604, a front support rear arm 605, a front support front link, a front support block 606, a front support front arm 607, a front support rear link, and a front support front sliding seat 608;

The right end of the front support rear arm 605 is rotatably connected to the right end of the front support rear sliding seat 604, and the left and right ends of the front support block 606 are rotatably connected to the right end of the front support front arm 607 and the let end of the front support rear arm 605 respectively, the left end of the front support front arm 607 is rotatably connected with the left end of the front support front sliding seat 608, the left and right ends of the front support front link are respectively connected with the middle of the front support block 606 and the left end of the front support rear sliding seat 604, and the left and right ends of the front support rear link are rotatably connected with the right end of the front support front sliding seat 608 and the middle part of the front support block 606 respectively:

The front support cylinder flange 601, the front support front sliding seat 608 are threadedly connected with the front main body 8 to limit the relative position of the front support sub 6; the front support rear sliding seat 604 is connected with the protruding portion of the front support cylinder piston 602, and the front support front sliding seat 608 is connected with the right end of the nut 510;

The front main body 8 is provided with a front oil hole that is communicated with the front support cylinder 603, the front control sub 7 includes a front control sub main body 701, and the front control sub main body 701 is provided with a front control sub built-in groove 702, a front control sub power hole 703, and a front oil passage 704, and the rear control sub built-in groove 202 is communicated with the front oil hole through the front oil passage 704.

When the hydraulic oil flows into the right chamber of the front support cylinder 603 through the front oil passage 704, the front support cylinder piston 602 extends and pushes the front support rear sliding seat 604, thereby driving the support mechanism to open for support in the casing; when the hydraulic oil flows into the left chamber of the front support cylinder 603, the front support cylinder piston 602 retracts and pulls the front support rear sliding seat 604, thereby driving the support mechanism to contract.

The front joint 9 is at the right end (near well-bottom end) of the front main body 8, and is used to connect with other downhole operating tools. The front main body 8 passes through the front control sub 7 and the front support sub 6; the front control sub built-in groove 702 is used for placing electronic components such as hydraulic valves and used as a hydraulic oil tank.

In this embodiment, both the rear support sub 4 and the front support sub 6 are provided with pressure sensors.

Figure 8:
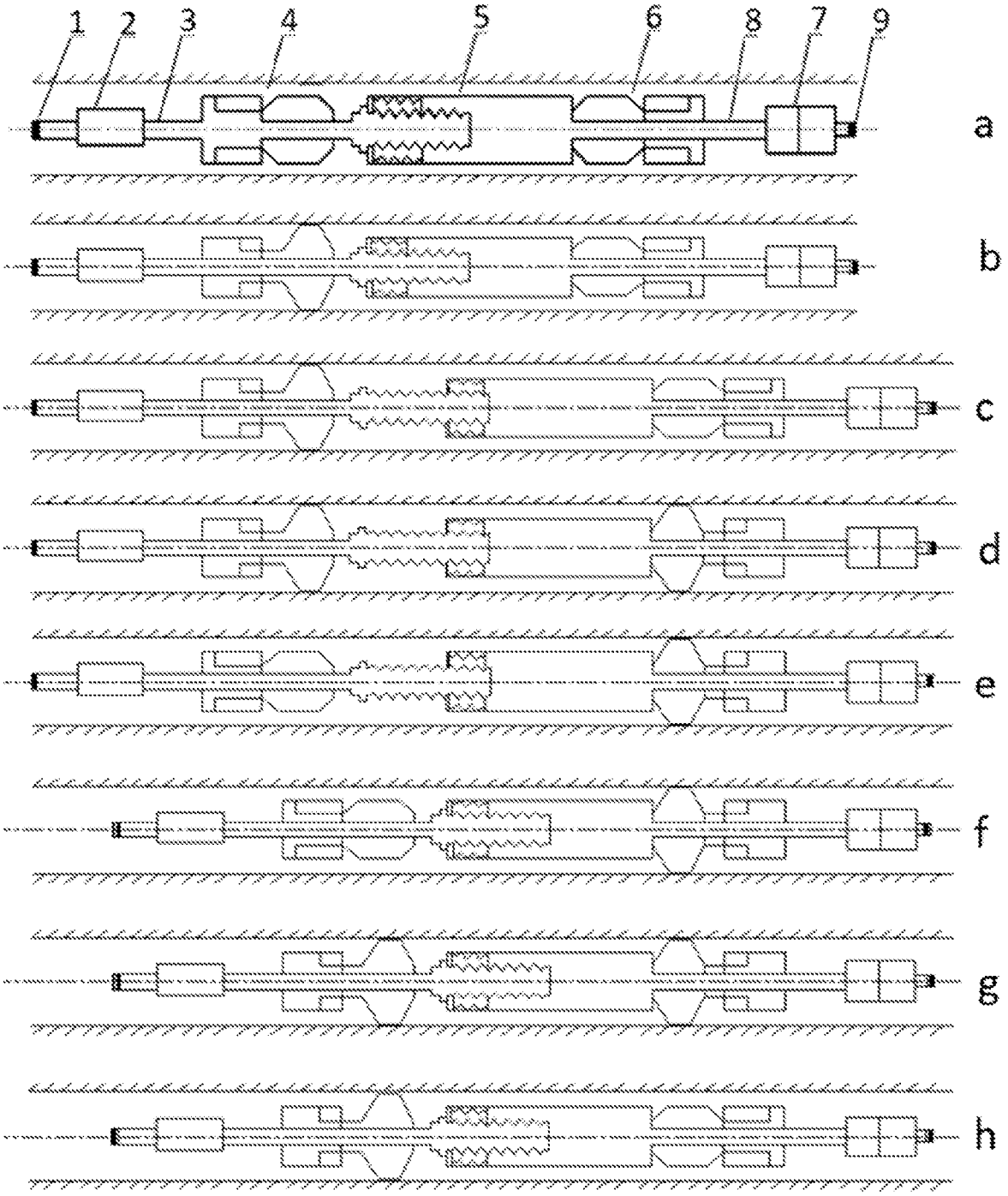
FIG. 8 is a schematic diagram of the action of the explosion robot based on the planetary roller screw telescoping.

As shown in FIG. 8, the entire working states of this embodiment are as follows:

State a: In this state, the initial state of the explosion robot entering the horizontal well is that the rear support cylinder piston 403 is located at the left end of the rear support cylinder 402, the rear support mechanism is in a contracted state, and the planetary roller 507 in the telescopic sub 5 is located at the left end of the lead screw 511 and the nut 510 at the same time; the front support cylinder piston 602 is located at the right end of the front support cylinder 603, and the front support mechanism is in a contracted state;

State b: The electrical signal is connected to the rear joint 1, and is transmitted to the rear control sub 2 through the circuit in the rear main body 3, the solenoid valve in the rear control sub built-in groove 202 starts to work, the hydraulic oil flows into the rear oil passage 204 in the rear main body 3 through the solenoid valve, the hydraulic oil flows into the left chamber of the rear support cylinder 402 through the rear oil hole matched with the rear main body 3, thereby pushing the rear support cylinder piston 403 to move to the right; when the rear support cylinder piston 403 moves to the right, it drives the rear support rear sliding seat 404 to slide to the right, the rear support mechanism is opened and in close contact with the casing to fix the entire robot and prevent the movement process from being affected by the drifting of the body;

State c: after the rear support mechanism is in close contact with the casing to fix the entire rear half, and the pressure sensor receives the contact signal with the casing, the solenoid valve in the rear control sub 2 suspends pumping hydraulic oil into the rear support cylinder 402; the second half of the robot maintains this state, the electrical signal in the rear control sub 2 is transmitted to the telescopic sub 5 through the circuit in the annulus of the rear main body 3, the drive motor 504 in the telescopic sub 5 starts to rotate, the drive motor 504 in the telescopic sub 5 is matched with the coupling and the bearing 505, and the bearing 505 is in an interference fit with the lead screw 511; the drive motor 504 rotates the lead screw 511, due to the existence of the bearing 505, the entire pipe string does not rotate, and still maintains a stable state, and only the lead screw 511 rotates; the lead screw 511 and the planetary roller 507 are meshed through the planetary gears and threaded, and the lead screw 511 rotates to drive the planetary roller 507 to roll; the nut 510, which is threaded with the planetary roller 507, moves linearly to the right relative to the telescopic protective cover 501 under the movement of the planetary roller 507; the front half of the robot connected with the nut 510 also moves to the right along with the linear motion of the nut 510 until the planetary roller 507 completes the entire stroke of the lead screw 511, the telescopic sub 5 completes the extension action, and the front half of the robot approaches the near well-bottom end (operation end).

State d: After the telescopic sub 5 is extended, the drive motor 504 stops rotating, and the planetary ball screw structure has good self-locking performance and maintains the self-locking state; the electrical signal in the annulus of the rear main body 3 passes through the circuit in the annulus of the lead screw 511 and enters the front control sub 7 via the annulus of the front main body 8; after the front control sub 7 receives the electrical signal, the control circuit controls the solenoid valve in the front control sub built-in groove 702 to start working, and the hydraulic oil in the front control sub built-in groove 702 flows into the hydraulic oil passage 704 in the front main body 8 through the solenoid valve, and the hydraulic oil flows into the right chamber of the front support cylinder 603 through the front oil passage 704, thereby pushing the front support cylinder piston 602 to move to the left; the front support cylinder piston 602 is threadedly connected to the front support rear sliding seat 604, when the front support cylinder piston 602 moves to the left, it drives the front support rear sliding seat 604 to slide to the left, and the front support mechanism is opened and is in close contact with the casing to fix the front half of the entire robot; at this time, the front and rear support mechanisms of the explosion robot are in close contact with the casing to prevent the movement process from being affected by the drifting of the body;

State e: after the front support mechanism is opened and in close contact with the casing to fix the body, the rear support mechanism is reset and contracted, the rear half of the robot is not fixed, and only when the telescopic joint 5 is working, the second half of the robot can be pulled to the operating end; at this time, the control solenoid valve in the control sub 2 works, and the hydraulic oil flows into the hydraulic oil circuit in the annulus of the rear main body 3 through the solenoid valve; at this time, the hydraulic oil enters the right chamber of the rear support cylinder 402, the left chamber returns to oil, and the rear support cylinder piston 403 moves to the left to drive the rear support mechanism to contract and reset.

State f: After the rear support mechanism is reset, the drive motor 504 starts to reverse. Since the front support mechanism is in an open state and is in close contact with the casing, the nut 510 is fixed to the front support rear sliding seat 604, resulting in the nut 510 cannot move to the left when the drive motor 504 reverses. At this time, as the rear support mechanism is not in contact and fixed with the casing, under the reverse drive of the motor, the lead screw 511 rotates and moves horizontally to the right, so that the nut 510 moves to the left relative to the telescopic protective cover 501, thus pulling the rear half of the entire robot forward, at this time, the planetary roller 507 and the nut 510 in the telescopic sub 5 return to the leftmost end of the lead screw 511.

State g: After the planetary roller screw mechanism in the telescopic sub 5 is reset, the rear control sub 2 controls the solenoid valve therein to control the flow to the left chamber of the rear support cylinder 402, and pushes the rear support cylinder piston 403 to move to the right to drive the rear support mechanism open and make close contact with the casing to fix the robot.

State h: After the rear support mechanism is in close contact with the casing to fix the body, the front control sub 7 controls the solenoid valve therein to control the hydraulic oil to flow into the right chamber of the front support cylinder 603, and pushes the front support cylinder piston 602 to move to the left, thereby pushing the front support mechanism to contract and reset for the next action.

The states b to h are cycled to complete the horizontal movement of the explosive fracturing robot and the traction of the remaining downhole operating tools and pipe strings.

Figure 7:
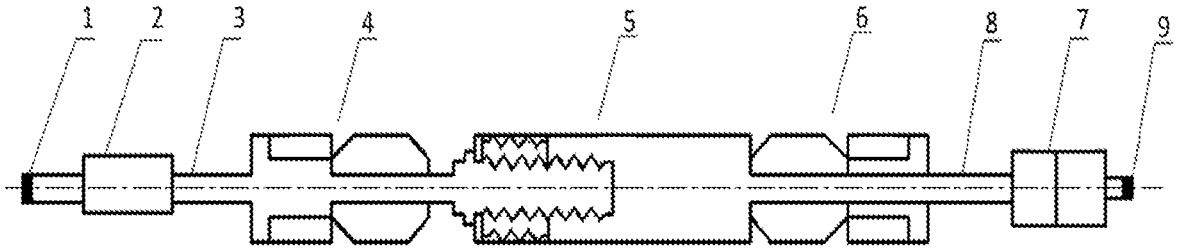
FIG. 7 is a schematic diagram of the structure of the present invention.

As shown in FIG. 7 and FIG. 8, a traction method of a downhole explosion robot based on planetary roller screw telescoping comprises the following steps:

Step 1. Adjust the explosion robot to the initial state, and the initial state is that the rear support cylinder piston 403 is located at the left end of the rear support cylinder 402, the front support cylinder piston 602 is located at the right end of the front support cylinder 603, the rear support mechanism and the front support mechanism are both in a contracted state, and the planetary roller 507 is located at the left end of the lead screw 511 and the nut 510;

Step 2. Inject hydraulic oil into the left chamber of the rear support cylinder 402 to push the rear support cylinder piston 403 to move to the right, so as to drive the rear support mechanism to open and make close contact with the casing to fix the rear half of the entire explosion robot;

Step 3. The drive motor 504 starts to rotate forward, and the drive motor 504 rotates to drive the lead screw 511 to rotate. Since the lead screw 511 and the planetary roller 507 are threadedly matched, the lead screw 511 rotates to drive the planetary roller 507 to roll; the nut 510 moves to the right together with the planetary roller 507 under the movement of the planetary roller 507; at the same time, the front half of the explosion robot connected with the nut 510 also advances to the right with the nut 510 until the planetary roller 507 moves to the rightmost end of the lead screw 511;

Step 4. Inject hydraulic oil into the right chamber of the front support cylinder 603, thereby pushing the front support cylinder piston 602 to move to the left; when the front support cylinder piston 602 moves to the left, it drives the front support mechanism to open, and make close contact with the casing to fix the front half of the entire explosion robot;

Step 5. Inject hydraulic oil into the right chamber of the rear support cylinder 402, the left chamber of the rear support cylinder 402 returns oil, and at the same time the rear support cylinder piston 403 moves to the left to drive the rear support mechanism to contract and reset:

Step 6. After the rear support mechanism is reset, the drive motor 504 starts to reverse, the lead screw 511 rotates and moves to the right, and the lead screw 511 pulls the second half of the entire explosion robot forward until the planetary roller 507 returns to the leftmost end of the lead screw 511;

Step 7. Inject hydraulic oil into the left chamber of the rear support cylinder 402, push the rear support cylinder piston 403 to move to the right, thereby driving the rear support mechanism to open and make close contact with the casing to fix the second half of the entire explosion robot;

Step 8. Inject hydraulic oil into the left chamber of the front support cylinder 603, push the front support cylinder piston 602 to move to the right, thereby driving the front support mechanism to contract and reset, so as to carry out the next action;

Step 9. Cycle Step 3 to Step 8 to complete the horizontal movement of the explosive fracturing robot, and complete the delivery of the downhole explosion operating tools and other tools to the designated position and the traction of the pipe string;

Step 10. After completing the delivery of the downhole explosion operating tools and other tools to the designated position and the traction of the pipe string, inject hydraulic oil into the right chamber of the rear support cylinder 402, push the rear support cylinder piston 403 move to the left, thereby driving the rear support mechanism to retract and reset, so that the entire explosion robot returns to its initial state.

In this method, the injection process of the hydraulic oil in Step 2 is: The control circuit controls the solenoid valve in the rear control sub 2 to start working, the hydraulic oil in the oil cylinder in the rear control sub 2 flows into the rear oil hole in the rear main body 3 through the solenoid valve, and the hydraulic oil finally flows into the left chamber of the rear support cylinder 402;

In Step 2, after the rear support mechanism is in close contact with the casing, the pressure sensor sends a signal to the control circuit, and the control circuit controls the solenoid valve in the rear control sub 2 to stop pumping hydraulic oil into the rear support cylinder 402.

The injection process of the hydraulic oil in Step 4 is: the control circuit controls the solenoid valve in the front control sub 7 to start working, the hydraulic oil in the front control sub 7 flows into the front oil hole in the front main body 8 through the solenoid valve, and the hydraulic oil finally flows into the right chamber of the front support cylinder 603;

In Step 4, after the front support mechanism is in close contact with the casing, the pressure sensor sends a signal to the control circuit, and the control circuit controls the solenoid valve in the front control sub 7 to stop pumping hydraulic oil into the front support cylinder 603.

The above are not intended to limit the present invention in any form. Although the present invention has been disclosed as above with above embodiments, it is not intended to limit the present invention. Those skilled in the art, within the scope of the technical solution of the present invention, can use the disclosed technical content to make a few changes or modify the equivalent embodiment with equivalent changes. Within the scope of the technical solution of the present invention, any simple modification, equivalent change and modification made to the above embodiments according to the technical essence of the present invention are still regarded as a part of the technical solution of the present invention.

What is claimed is:

1. A downhole explosion robot based on planetary roller screw telescoping, comprising a rear joint (1), a rear main body (3), a telescopic sub (5), a front main body (8), and a front joint (9) connected in sequence from left to right, the rear main body (3) and the front main body (8) are provided with axial through-holes, and the rear main body (3) is provided with a rear control sub (2) and a rear support sub (4); the front main body (8) is provided with a front support sub (6) and a front control sub (7), and the telescopic sub (5) is respectively connected with the rear support sub (4) and the front support sub (6), wherein the front support sub (6), the front control sub (7), the front main body (8) and the front joint (9) are respectively distributed symmetrically with the rear support sub (4), the rear control sub (2), the rear main body (3) and the rear joint (1) with respect to the telescopic sub (5); the rear control sub (2) controls the rear support sub (4) to enter support state or non-support state, and the front control sub (7) controls the front support sub (6) to enter support state or non-support state;

the rear support sub (4) comprises a rear support cylinder (402), a rear support cylinder flange (401), a rear support cylinder piston (403), and a rear support mechanism, the rear support cylinder flange (401) is connected with a left end of the rear support cylinder (402), and the rear support cylinder piston (403) is sleeved in a middle of the rear support cylinder (402) and the rear main body (3), and can slide relatively;

the rear support mechanism comprises a rear support rear sliding seat (404), a rear support rear arm (405), a rear support rear link, a rear support block (406), a rear support front arm (407), a rear support front link, and a rear support front sliding seat (408);

a left end of the rear support rear arm (405) is rotatably connected with a left end of the rear support rear sliding seat (404), and left and right ends of the rear support block (406) are respectively rotatably connected with a right end of the rear support rear arm (405) and a left end of the rear support front arm (407), a right end of the rear support front arm (407) is rotatably connected to a right end of the rear support front sliding seat (408), left and right ends of the rear support rear link are respectively rotatably connected to a right end of the rear support rear sliding seat (404) and a middle of the rear support block (406), and left and right ends of the rear support front link are respectively rotatably connected with the middle of the rear support block (406) and a left end of the rear support front sliding seat (408);

the rear support cylinder flange (401) and the rear support front sliding seat (408) are threadedly connected with the rear main body (3) to limit a relative position of the rear support sub (4); the rear support rear sliding seat (404) is connected with a protruding portion of the rear support cylinder piston (403);

the telescopic sub (5) comprises a telescopic protective cover (501), a motor fixing frame (503), a drive motor (504), a bearing (505) and a planetary roller screw mechanism slidably installed in the telescopic protective cover (501); the planetary roller screw mechanism comprises a plurality of planetary rollers (507), a nut (510), and a lead screw (511);

the motor fixing frame (503) and the bearing (505) are installed in a left end of the telescopic protective cover (501), the drive motor (504) is installed on the motor fixing frame (503), the telescopic protective cover (501) is internally provided with a limit rail (502), and the nut (510) is slidably installed in the limit rail (502);

both ends of each of the plurality of the planetary rollers (507) are provided with a gear teeth (506) and a cage (508) in sequence from an inside to an outside, each of the plurality of the planetary rollers (507) is threadedly installed in the nut (510), and the nut (510) is internally provided with a snap ring (509) for limiting the plurality of the planetary rollers (507) at a left end of an inner chamber of the nut (510); and the lead screw (511) is installed in the bearing (505) and the plurality of the planetary rollers (507), and a rotating shaft of the drive motor (504) is connected with the lead screw (511) through a coupling; the telescopic protective cover (501) is connected with the rear support front sliding seat (408).

2. The downhole explosion robot according to claim 1, wherein the rear main body (3) is provided with a rear oil hole that is communicated with the rear support cylinder (402), the rear control sub (2) comprises a rear control sub main body (201), the rear control sub main body (201) is provided with a rear control sub built-in groove (202), a rear control sub power hole (203), and a rear oil passage (204), and the rear control sub built-in groove (202) is communicated with the rear oil hole through the rear oil passage (204).

3. The downhole explosion robot according to claim 1, wherein the front support sub (6) comprises a front support cylinder (603), a front support cylinder flange (601), a front support cylinder piston (602), and a front support mechanism; the front support cylinder flange (601) is connected with a right end of the front support cylinder (603), and the front support cylinder piston (602) is sleeved in a middle of the front support cylinder (603) and the front main body (8), and can slide relatively;

the front support mechanism comprises a front support rear sliding seat (604), a front support rear arm (605), a front support front link, a front support block (606), a front support front arm (607), a front support rear link, and a front support front sliding seat (608);

a right end of the front support rear arm (605) is rotatably connected to a right end of the front support rear sliding seat (604), and left and right ends of the front support block (606) are rotatably connected to aright end of the front support front arm (607) and a left end of the front support rear arm (605) respectively, a left end of the front support front arm (607) is rotatably connected with a left end of the front support front sliding seat (608), left and right ends of the front support front link are respectively connected with a middle of the front support block (606) and a left end of the front support rear sliding seat (604), and left and right ends of the front support rear link are rotatably connected with aright end of the front support front sliding seat (608) and the middle part of the front support block (606) respectively;

the front support cylinder flange (601), the front support front sliding seat (608) are threadedly connected with the front main body (8) to limit a relative position of the front support sub (6); the front support rear sliding seat (604) is connected with a protruding portion of the front support cylinder piston (602), and the front support front sliding seat (608) is connected with a right end of the nut (510).

4. The downhole explosion robot according to claim 3, wherein the front main body (8) is provided with a front oil hole that is communicated with the front support cylinder (603), the front control sub (7) comprises a front control sub main body (701), and the front control sub main body (701) is provided with a front control sub built-in groove (702), a front control sub power hole (703), and a front oil passage (704), and the rear control sub built-in groove (202) is communicated with the front oil hole through the front oil passage (704).

5. The downhole explosion robot according to claim 1, wherein both the rear support sub (4) and the front support sub (6) are provided with pressure sensors.

6. A traction method of a downhole explosion robot based on planetary roller screw telescoping, wherein the downhole explosion robot based on planetary roller screw telescoping according to claim 1 is used, specifically comprising following steps:

Step 1, adjust the downhole explosion robot to an initial state, and the initial state is that the rear support cylinder piston (403) is located at the left end of the rear support cylinder (402), the front support cylinder piston (602) is located at the right end of the front support cylinder (603), the rear support mechanism and the front support mechanism are both in a contracted state, and each of the plurality of the planetary rollers (507) is located at a left end of the lead screw (511) and the nut (510);

Step 2, inject hydraulic oil into a left chamber of the rear support cylinder (402) to push the rear support cylinder piston (403) to move to the right, so as to drive the rear support mechanism to open and make close contact with a casing to fix a rear half of an entire downhole explosion robot;

Step 3, the drive motor (504) starts to rotate forward, and the drive motor (504) rotates to drive the lead screw (511) to rotate; since the lead screw (511) and the plurality of the planetary rollers (507) are threadedly matched, the lead screw (511) rotates to drive each of the plurality of the planetary rollers (507) to roll; the nut (510) moves to the right together with the plurality of the planetary rollers (507) under movement of the plurality of the planetary rollers (507); at a same time, a front half of the downhole explosion robot connected with the nut (510) also advances to the right with the nut (510) until the plurality of the planetary rollers (507) moves to a rightmost end of the lead screw (511);

Step 4, inject hydraulic oil into a right chamber of the front support cylinder (603), thereby pushing the front support cylinder piston (602) to move to the left; when the front support cylinder piston (602) moves to the left, so as to drive the front support mechanism to open, and make close contact with the casing to fix the front half of the entire downhole explosion robot;

Step 5, inject hydraulic oil into a right chamber of the rear support cylinder (402), the left chamber of the rear support cylinder (402) returns oil, and at a same time the rear support cylinder piston (403) moves to the left to drive the rear support mechanism to contract and reset;

Step 6, after the rear support mechanism is reset, the drive motor (504) starts to reverse, the lead screw (511) rotates and moves to the right, and the lead screw (511) pulls a second half of the entire downhole explosion robot forward until the plurality of the planetary rollers (507) returns to a leftmost end of the lead screw (511);

Step 7, inject hydraulic oil into the left chamber of the rear support cylinder (402), push the rear support cylinder piston (403) to move to the right, thereby driving the rear support mechanism to open and make close contact with the casing to fix the second half of the entire explosion robot;

Step 8, inject hydraulic oil into a left chamber of the front support cylinder (603), push the front support cylinder piston (602) to move to the right, thereby driving the front support mechanism to contract and reset, so as to carry out a next action;

Step 9, repeat Step 3 to Step 8 to complete a horizontal movement of the downhole explosion robot, and complete the delivery of downhole explosion operating tools and other tools to a designated position and a traction of a pipe string; and Step 10, after completing the delivery of the downhole explosion operating tools and other tools to the designated position and the traction of the pipe string, inject hydraulic oil into the right chamber of the rear support cylinder (402), push the rear support cylinder piston (403) move to the left, thereby driving the rear support mechanism to retract and reset, so that the entire downhole explosion robot returns to the initial state.

7. The traction method according to claim 6, wherein the injection process of the hydraulic oil in step 2: a control circuit controls a solenoid valve in the rear control sub (2) to start working, the hydraulic oil in an oil cylinder in the rear control sub (2) flows into the rear oil hole in the rear main body (3) through the solenoid valve, and the hydraulic oil finally flows into the left chamber of the rear support cylinder (402);

In step 2, after the rear support mechanism is in close contact with the casing, pressure sensors send a signal to the control circuit, and the control circuit controls the solenoid valve in the rear control sub (2) to stop pumping hydraulic oil into the rear support cylinder (402).

8. The traction method according to claim 6, wherein the injection process of the hydraulic oil in step 4: a control circuit controls a solenoid valve in the front control sub (7) to start working, the hydraulic oil in the front control sub (7) flows into the front oil hole in the front main body (8) through the solenoid valve, and the hydraulic oil finally flows into the right chamber of the front support cylinder (603);

In step 4, after the front support mechanism is in close contact with the casing, pressure sensors send a signal to the control circuit, and the control circuit controls the solenoid valve in the front control sub (7) to stop pumping hydraulic oil into the front support cylinder (603).

* * * * *